US011767739B2

(12) United States Patent
Daly

(10) Patent No.: US 11,767,739 B2
(45) Date of Patent: Sep. 26, 2023

(54) PERFORATING GUN FOR OIL AND GAS WELLS, AND SYSTEM AND METHOD FOR USING THE SAME

(71) Applicant: Expro Americas, LLC, Houston, TX (US)

(72) Inventor: Kerry Daly, Conroe, TX (US)

(73) Assignee: Expro Americas, LLC, Houston, TX (US)

( * ) Notice: Subject to any disclaimer, the term of this patent is extended or adjusted under 35 U.S.C. 154(b) by 0 days.

(21) Appl. No.: 16/863,480

(22) Filed: Apr. 30, 2020

(65) Prior Publication Data

US 2021/0340846 A1 Nov. 4, 2021

(51) Int. Cl.

| | |
|---|---|
| ***E21B 43/117*** | (2006.01) |
| ***E21B 43/1185*** | (2006.01) |
| ***E21B 43/119*** | (2006.01) |

(52) U.S. Cl.

CPC ..... *E21B 43/117* (2013.01); *E21B 43/1185* (2013.01); *E21B 43/1195* (2013.01); *E21B 43/11852* (2013.01); *E21B 43/11855* (2013.01)

(58) Field of Classification Search

CPC ..... E21B 43/11855; E21B 43/117; E21B 43/1185; E21B 43/119; E21B 47/06; E21B 43/11852; E21B 43/1195

See application file for complete search history.

(56) References Cited

U.S. PATENT DOCUMENTS

| | | | | |
|---|---|---|---|---|
| 5,046,567 | A | 9/1991 | Aitken | |
| 5,355,802 | A | 10/1994 | Petitjean | |
| 7,810,569 | B2 * | 10/2010 | Hill | E21B 23/065 166/299 |
| 8,522,863 | B2 * | 9/2013 | Tiernan | E21B 43/263 166/63 |
| 8,910,556 | B2 * | 12/2014 | Umphries | E21B 43/11852 89/1.15 |
| 9,181,790 | B2 * | 11/2015 | Mace | F42D 3/06 |
| 10,024,145 | B1 * | 7/2018 | Schmidt | E21B 43/117 |
| 10,337,301 | B2 * | 7/2019 | Harive | E21B 43/1185 |
| 10,760,384 | B2 * | 9/2020 | Schmidt | E21B 43/117 |
| 2010/0147587 | A1 * | 6/2010 | Henderson | E21B 43/117 175/2 |
| 2012/0018156 | A1 | 1/2012 | Grove | |
| 2020/0199957 | A1 * | 6/2020 | Bertoja | E21B 23/00 |

OTHER PUBLICATIONS

International search report for PCT/US21/30133 dated Aug. 19, 2021.

* cited by examiner

*Primary Examiner* — Nicole Coy
(74) *Attorney, Agent, or Firm* — Getz Balich LLC

(57) ABSTRACT

A perforating gun, system and method is provided. The perforating gun includes a body, a plurality of shaped charges, at least one initial propellant and may include an actuating mechanism. The plurality of shaped charges are mounted within the body, and each shaped charge has an amount of an explosive material. The actuating mechanism is in communication with each shaped charge and the at least one initial propellant. The actuating mechanism is configured to fire the at least one initial propellant before firing any of the plurality of shaped charges.

12 Claims, 6 Drawing Sheets

PERFORATING GUN FOR OIL AND GAS WELLS, AND SYSTEM AND METHOD FOR USING THE SAME

BACKGROUND OF THE INVENTION

1. Technical Field

The present disclosure relates to apparatus, systems, and methods for use in a subterranean well for hydrocarbon fluid production, and in particular to apparatus, systems, and methods for use in a subterranean well that include a perforating gun for generating perforations within a well casing.

2. Background Information

Subterranean wellbores are often created to provide access to a hydrocarbon bearing subterranean formation so that hydrocarbon materials may be removed from the formation. Typically, a wellbore is drilled and a hollow well casing is inserted into the well bore. The well casing increases the integrity of the wellbore and the interior passage of the well casing provides a path through which fluids from the formation may be produced to the surface. In some instances, voids between the well bore and the exterior of the well casing may be filled with a material (e.g., cement) to secure the well casing within the well bore. To permit the influx of fluids into the well casing (and removal from the well), it is sometimes necessary to create hydraulic openings or perforations through the well casing (and cement where used) to provide fluid communication between the interior passage of the well casing and the exterior subterranean formation. In many instances, it is desirable to not only perforate the well casing and any peripheral cement, but also to extend the perforation into the surrounding subterranean formation Perforations may be created using a perforating gun deployed within the well casing at a selected position within the well bore. Perforating guns typically include a plurality of shaped charges that upon actuation create a fluid jet (e.g., high pressure gas produced by the combustion of the explosive material) in a particular direction (e.g., radially outwardly from the perforating gun body). The fluid jet is capable of perforating the well casing aligned with the shaped charge, and extending into the subterranean formation radially outside the well casing.

To enable a perforating gun to be positioned at a given location within a well casing, the perforating gun must have an outer diameter that is less than the inner diameter of the well casing. The difference in diameter produces an annular body of well fluid surrounding the perforating gun. More specifically, some amount of well fluid is disposed between the outer diameter of the perforating gun and the well casing inner diameter surface (the radial distance sometimes referred to as the "standoff"). As a result, the fluid jet produced by the shaped charge during the perforation process must extend through the standoff distance of well fluid prior to encountering the well casing, cement, and subterranean formation (e.g., see FIG. 1). Hence, the well fluid provides an impediment to the shaped charge fluid jet and therefore the perforation process.

In some instances, a perforating gun may be configured to operate in a two-stage manner. For example, some perforating guns are configured with a sleeve of solid propellant disposed radially outside of the perforation gun body that supports the shaped charges, and in particular radially outside of the shaped charges (e.g., see FIG. 2). The solid propellant is a different material than the shaped charge explosive material; e.g., the solid propellant releases energy approximately 1,000 times slower than the explosive material. When the perforating gun is actuated, the explosive material of each shaped charge is fired, thereby producing a radially directed fluid jet at a very high pressure (e.g., ~1 million psi) that traverses the propellant sleeve, the well fluid radially outside the propellant sleeve, the well casing wall, the cement disposed radially outside the well casing, and then traverses into the subterranean formation, typically forming a plurality of perforations within the formation. The firing of each shaped charge causes the solid propellant sleeve to fire, and the pressure produced by the firing of propellant sleeve creates a secondary gas pressure (typically at about 25,000 psi) that travels through the well casing and cement perforations, and into the subterranean formation perforations. The high speed and intense pressure of the fluid jet often crushes the subterranean formation materials to create the perforation in the formation. The secondary pressure produced by the slower acting and lower pressure solid propellant produces a different result within the formation, creating a plurality of fractures within the formation in communication with initially formed perforation. Hence, this type of perforating gun may be referred to as a two-stage perforating gun; i.e., initial perforation followed by a secondary pressurization that physically changes the initially formed formation perforation to enhance fluid flow into the formation perforation and subsequently into the well casing.

A second type of two-stage perforating gun includes a plurality of secondary solid propellants disposed within the body of the perforating gun rather than an external sleeve of solid propellant (e.g., see FIG. 3). This type of two-stage perforating gun operates in a similar manner to that described above except that the fluid jet produced by the shaped charge does not need to initially perforate the solid propellant. After the fluid jet creates the perforations (e.g., through the well fluid in the standoff, the well casing, the cement, and into the formation), the solid propellant is fired and creates the secondary pressurization that physically changes the initially formed formation perforation to enhance fluid flow into the formation perforation and subsequently into the well casing.

A third type of two-stage perforating gun includes a shaped charge assembly that includes a composite solid propellant cap (e.g., see FIG. 4). The shaped charge assembly is configured conventionally configured and further includes an amount of solid propellant disposed radially outside of the shaped charge explosive material. This type of two-stage perforating gun operates in a similar manner to that described above; e.g., the fluid jet produced by the shaped charge initially perforates the solid propellant, and subsequently perforates the well fluid in the standoff, the well casing, the cement, and into the formation. Subsequent to the firing of the shaped charge, the solid propellant is fired and creates the secondary pressurization that physically changes the initially formed formation perforation to enhance fluid flow into the formation perforation and subsequently into the well casing.

In all of the perforating guns of which we are aware, the fluid jet produced by the firing of the shaped charge must penetrate well fluid (extending a standoff distance between the outer diameter of the perforating gun and inner diameter surface of the well casing). As indicated above, the well fluid provides an impediment to the shaped charge fluid jet and therefore the perforation process. More specifically, it is our discovery that the well fluid impedance can negatively affect the performance of the fluid jet; e.g., decrease the diameter of the perforations formed in the well casing and cement (referred to hereinafter as the entrance hole diameter, or "EHD"), and/or the depth of the formation penetration created by the fluid jet (referred to as the "formation penetration", or "PEN").

In the operation of some of the known two stage perforating guns, the firing of the solid propellant after the firing of the shaped charge can produce a significant pressure event within the well fluid disposed within the well casing. Specifically, the secondary pressure intended to that physically change the initially formed formation perforation can drive the well fluid toward the well head (e.g., vertically upward). The well fluid driven at a pressure high enough to change the formation perforation can excessively pressurize by the well fluid. If excessive, that pressurized fluid can damage well devices (e.g., blow out protectors, or "BOP") and/or when the secondary pressure dissipates, cause a volume of the well fluid to crash back down into the formation. To avoid these issues, and the risks attendant thereto, known two stage perforating devices must be carefully configured based on the parameters of the specific well subject to the perforation process.

What is needed is a perforating gun and system, and method that provides an improvement over the perforating guns and systems known in the art.

SUMMARY

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

According to an aspect of the present disclosure, a perforating gun is provided that includes a body, a plurality of shaped charges, at least one initial propellant, and an actuating mechanism. The plurality of shaped charges may be mounted within the body, and each shaped charge has an amount of an explosive material. The actuating mechanism is in communication with each shaped charge and the at least one initial propellant. The actuating mechanism is configured to fire the at least one initial propellant before firing any of the plurality of shaped charges.

In any of the aspects or embodiments described above and herein, the at least one initial propellant may be a solid propellant.

In any of the aspects or embodiments described above and herein, the solid propellant may include at least one of potassium perchlorate, ammonium perchlorate, or barium perchlorate.

In any of the aspects or embodiments described above and herein, the perforating gun body may include a first axial end and a second axial end disposed opposite the first axial end. The at least one initial propellant may be configured to produce an amount of gas at an elevated pressure outside of the body upon being fired.

In any of the aspects or embodiments described above and herein, the amount of elevated pressure gas produced from the at least one propellant may be produced in a direction from the second axial end toward the first axial end.

In any of the aspects or embodiments described above and herein, the body may include a first axial end and a second axial end disposed opposite the first axial end, and the at least one initial propellant may be disposed between the second axial end and the plurality of shaped charges.

In any of the aspects or embodiments described above and herein, the actuating mechanism may be mechanically actuated.

In any of the aspects or embodiments described above and herein, the actuating mechanism may be electrically actuated.

According to an aspect of the present disclosure, a well casing perforation system for perforating a well casing within a subterranean well is provided. The well casing contains a well fluid, and the well casing has an inner passage defined by an inner surface. The system includes a perforating gun and a controller. The perforating gun having a body, a plurality of shaped charges, and at least one initial propellant. The plurality of shaped charges are mounted within the body. The perforating gun has an exterior diameter proximate the plurality of shaped charges. The controller is configured to selectively cause the perforating gun to actuate when the perforating gun is disposed within the well casing, which actuation of the perforating gun includes first causing the at least one initial propellant to fire, and second causing the plurality of shaped charges to fire.

In any of the aspects or embodiments described above and herein, the perforating gun body may include a first axial end and a second axial end disposed opposite the first axial end, and the at least one initial propellant may be configured to produce an amount of gas at an elevated pressure outside of the body upon being fired.

In any of the aspects or embodiments described above and herein, the amount of elevated pressure gas produced from the at least one propellant may be produced in a direction from the second axial end toward the first axial end.

In any of the aspects or embodiments described above and herein, the perforating gun may include a mechanically operated actuating mechanism, and the controller may be configured to cause actuation of the perforating gun actuating mechanism.

In any of the aspects or embodiments described above and herein, the perforating gun may include an electrically operated actuating mechanism, and the controller may be configured to cause actuation of the perforating gun actuating mechanism.

According to an aspect of the present disclosure, a method of perforating a well casing within a subterranean well is provided. The well casing contain a well fluid, and the well casing has an inner passage. The method includes: providing a perforating gun having a body, a plurality of shaped charges mounted within the body, and at least one initial propellant, wherein the perforating gun body has an exterior surface proximate the plurality of shaped charges; disposing the perforating gun within the well casing inner passage at a position where a diameter of the body exterior surface is less than an inner diameter of the well casing inner passage, at which position an annular region is disposed around the perforating gun and between the perforating gun and the well casing, and the annular region is filled with said well fluid; driving the well fluid out of the annular region by firing the at least one initial propellant in a manner the maintains the well fluid out of the annular region for a period of time; and perforating the well casing by firing the plurality of shaped charges during the period of time in which the well fluid is maintained out of the annular region.

In any of the aspects or embodiments described above and herein, the perforating gun body may include a first axial end and a second axial end disposed opposite the first axial end, and the perforating gun may be disposed within the well casing so that the second axial end is downhole of the first axial end, and firing the at least one initial propellant drives the well fluid in a direction from the second axial end toward the first axial end.

In any of the aspects or embodiments described above and herein, the perforating gun may include a mechanically operated actuating mechanism, and the at least one initial propellant may be fired by engaging the mechanically operated actuating mechanism.

In any of the aspects or embodiments described above and herein, the mechanically operated actuating mechanism may be engaged by a drop bar impact.

In any of the aspects or embodiments described above and herein, the perforating gun may include an electrically operated actuating mechanism, and the at least one initial propellant may be fired by engaging the electrically operated actuating mechanism.

In any of the aspects or embodiments described above and herein, the electrically operated actuating mechanism may be engaged by a signal sent from a well control station.

In any of the aspects or embodiments described above and herein, the perforating gun may include a pressure operated actuating mechanism, and the at least one initial propellant may be fired by subjecting the perforating gun to a predetermined first elevated pressure.

In any of the aspects or embodiments described above and herein, the plurality of shaped charges may be fired by subjecting the perforating gun to a predetermined second elevated pressure, which second elevated pressure is greater than the first elevated pressure.

BRIEF DESCRIPTION OF THE DRAWINGS

The present disclosure is illustrated by way of example and not limited in the accompanying figures in which like reference numerals indicate similar elements. The drawing figures are not necessarily drawn to scale unless specifically indicated otherwise.

DETAILED DESCRIPTION

Figure 1:
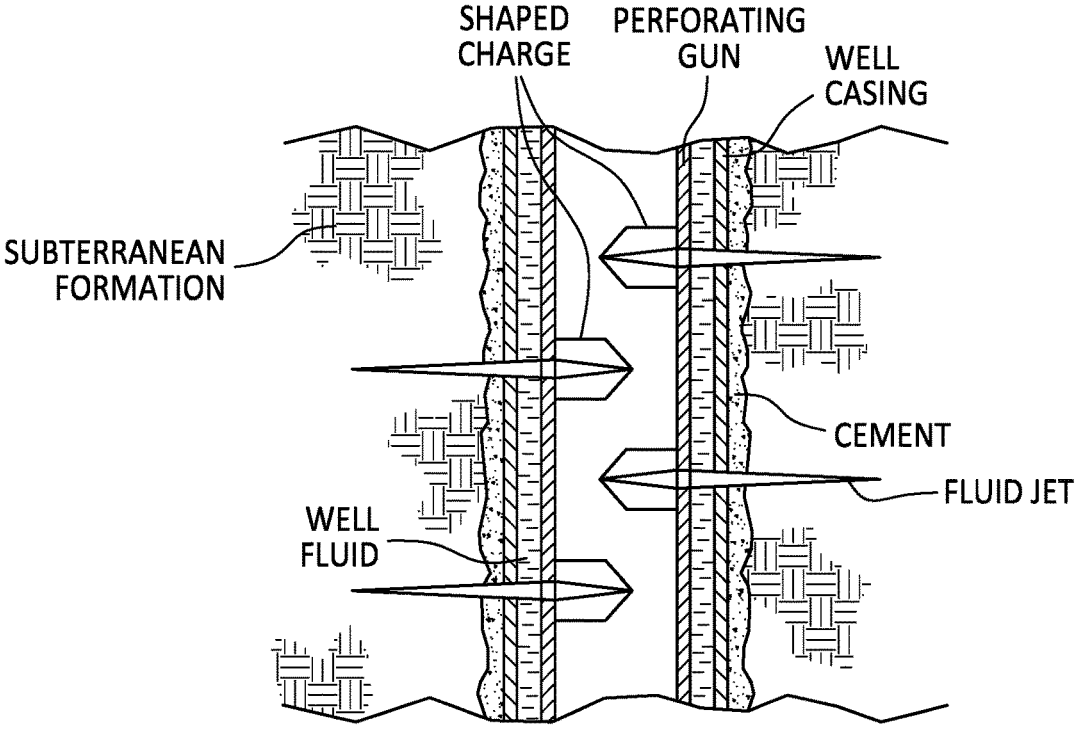
FIG. 1 (PRIOR ART)
FIG. 1 diagrammatically illustrates a prior art single stage perforating gun embodiment disposed within a well casing.
Figure 2:
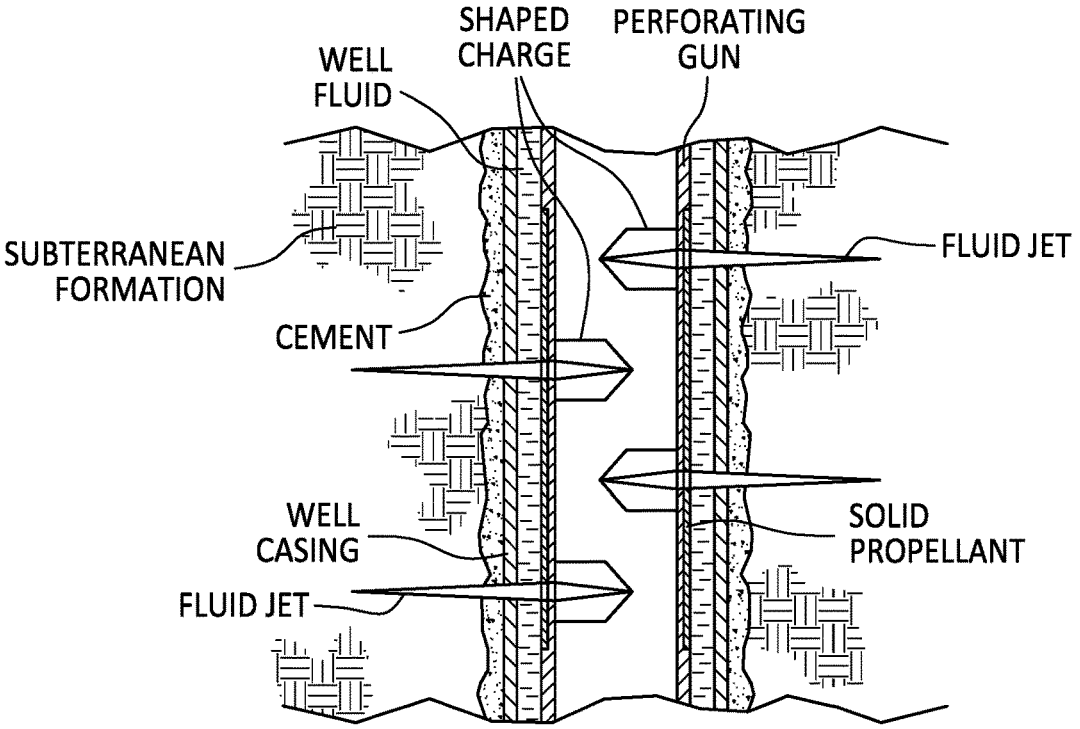
FIG. 2 (PRIOR ART)
FIG. 2 diagrammatically illustrates a prior art two stage perforating gun embodiment disposed within a well casing.
Figure 3:
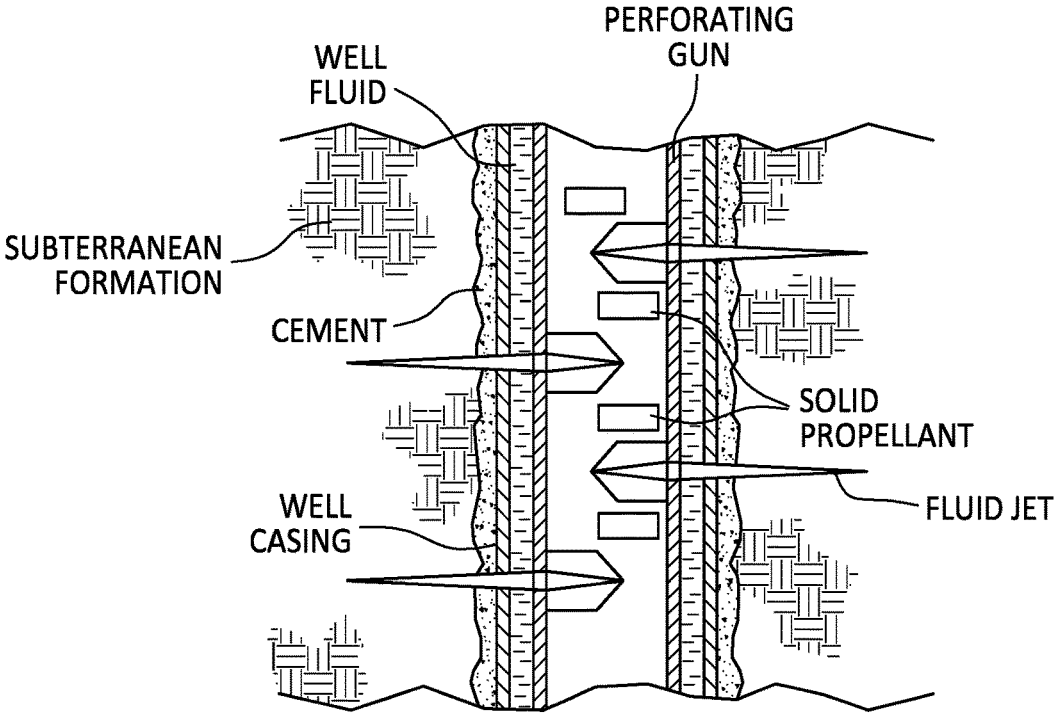
FIG. 3 (PRIOR ART)
FIG. 3 diagrammatically illustrates a prior art two stage perforating gun embodiment disposed within a well casing.
Figure 4:
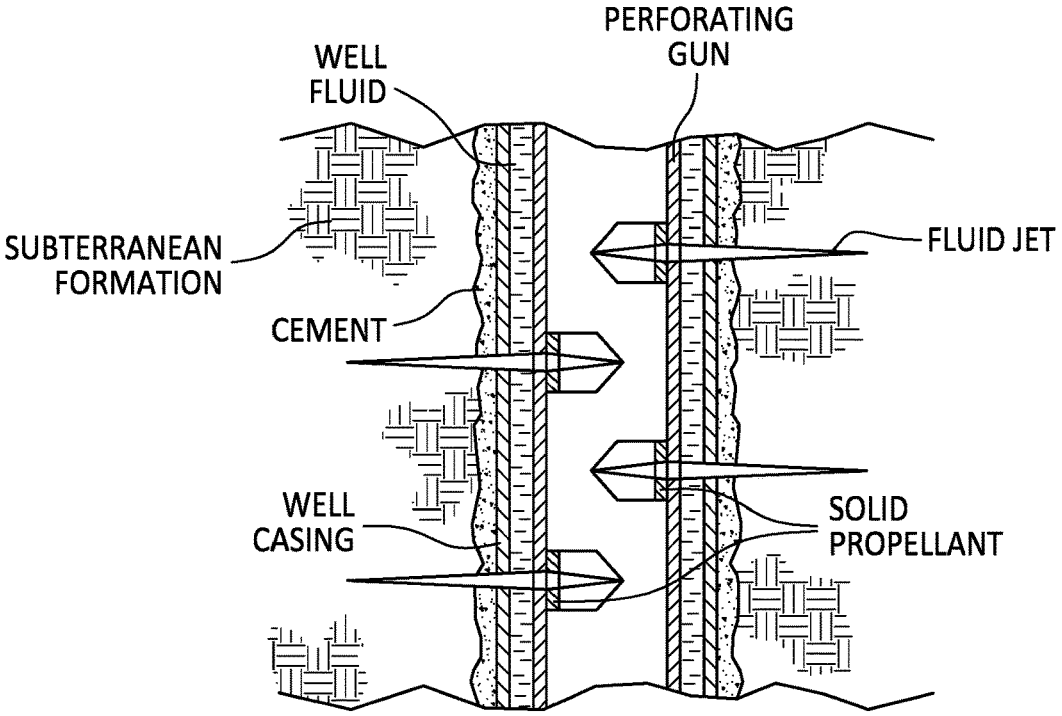
FIG. 4 (PRIOR ART)
FIG. 4 diagrammatically illustrates a prior art two stage perforating gun embodiment disposed within a well casing.

It is noted that various connections are set forth between elements in the following description and in the drawings (the contents of which are included in this disclosure by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities or a space/gap between the entities that are being coupled to one another.

Figure 5:
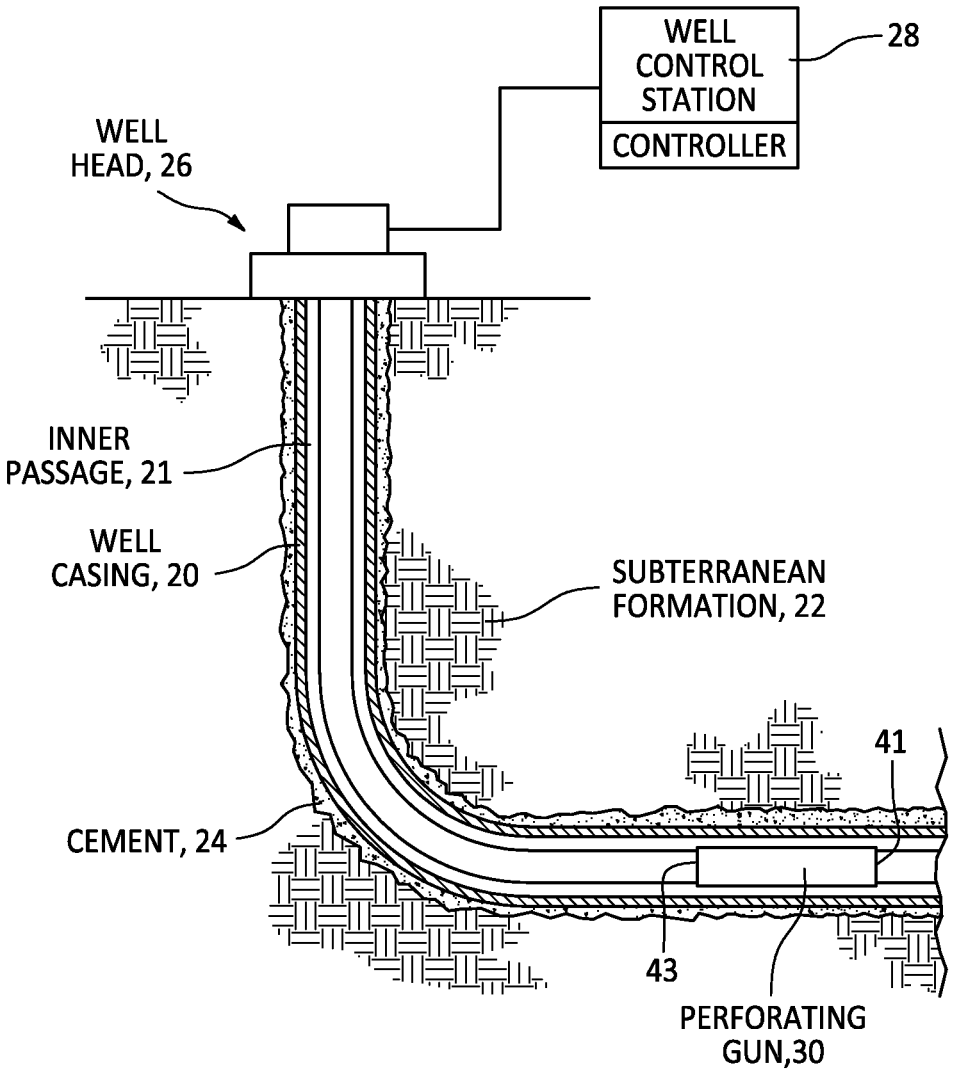
FIG. 5 is a diagrammatic illustration of a subterranean well having a perforating gun and well control station.

An exemplary subterranean well is diagrammatically shown in FIG. 5 having a well casing 20 that extends into and within a subterranean formation 22. The well casing includes an inner passage 21 defined by an inner diameter surface 35 disposed at an inner diameter "WCID" (see FIG. 7). The subterranean formation 22 may be land based, or may be disposed at the floor of a body of water (e.g., an ocean). In some instances, a product such as cement 24 may be disposed contiguous with the well casing 20 and the subterranean formation 22 to secure the well casing 20 within the subterranean formation 22. The well may include a well head 26 disposed above the subterranean formation 22 and the well head 26 may be in communication with a well control station 28. A perforating gun 30 is shown disposed within the inner passage 21 of the well casing 20. Aspects of the present disclosure include a system for actuating one or more perforation guns 30 within a subterranean well, a perforating gun 30, and a well casing perforating system.

Perforating guns 30 and associated apparatus can be utilized as part of an electric wireline perforating ("EWP") system, or as part of a tubing conveyed perforating ("TCP") system (shown in FIG. 5), or similar well systems. EWP systems utilize electrical signals to control downhole tooling including perforating guns. TCP systems, on the other hand, are often configured to use hydraulic pressure and/or mechanical force to control downhole tooling; e.g., to initiate a perforating gun 30. These type of systems may utilize sensors that provide information (e.g., pressure values, temperature values, time values, etc.) relating to downhole conditions, that can be used during the perforation of well casing 20 segments.

Regardless of the type of system (e.g., EWP, TCP, or the like) utilized to operate a perforating gun 30, the well control station 28 may be configured to communicate with and control the various components of the well perforating system. The well control station 28 may be located at the subterranean well site, or may be located remote from the subterranean well site. The well control station 28 may include a controller 32, one or more input devices (e.g., a keyboard, a touch screen type HMI display, etc.), and with one or more output devices (e.g., a monitor screen, an HMI display, etc.). The controller 32 may be directly or indirectly in communication with various system components, including the perforating gun 30 or components utilized to actuate the perforating gun 30. The controller 32 may include any type of computer, computing device, computational circuit, CPU, processor, microprocessor, digital signal processor, co-processor, micro-controller, microcomputer, field programmable gate array, programmable logic device, state machine, logic circuitry, analog circuitry, digital circuitry, any combination thereof, or any type of processing circuit or logic device capable of executing a series of instructions that are stored in a memory device. The instructions stored in the memory device may represent logic instructions (e.g., commands), one or more algorithms, etc., for operating some or all of the system components, individually and/or collectively. The stored instructions are not limited to any particular form (e.g., program files, system data, buffers, drivers, utilities, system programs, etc.) provided they can be executed by the controller 32; e.g., by one or more processors included in the controller 32. The memory device may be a non-transitory computer readable storage medium configured to store instructions that when executed by the controller 32, cause the controller 32 to perform or cause the performance of certain functions or commands. The memory device may be a single memory device or a plurality of memory devices. The memory device may include a storage area network, network attached storage, as well as a disk drive, a read-only memory, random access memory, volatile memory, non-volatile memory, static memory, dynamic memory, flash memory, cache memory, and/or any device that stores digital information. Communications between the controller 32 and the various system components are not limited to any particular format, and may be via a hard-wired communication system, or via a wireless communication system, or any combination thereof.

Figure 6:
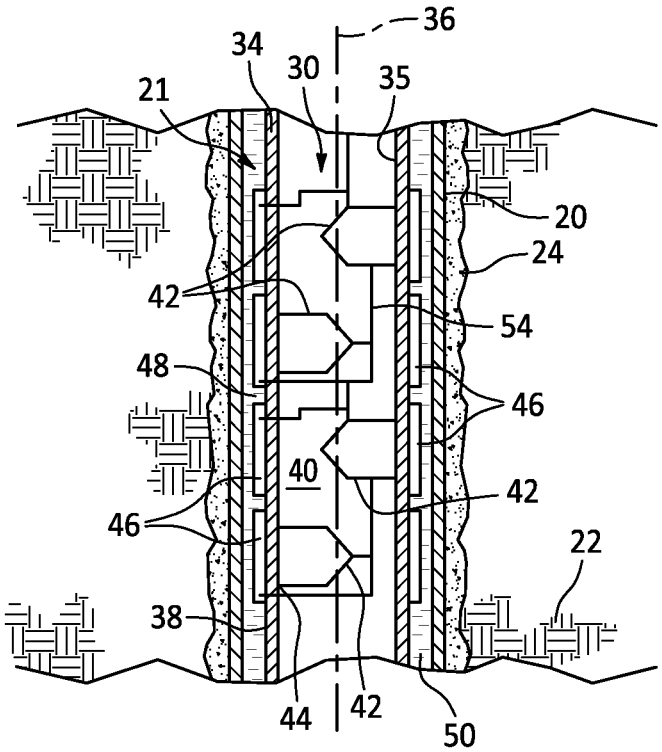
FIG. 6 diagrammatically illustrates a perforating gun embodiment disposed within a well casing according to the present disclosure in an unfired state.
Figure 7:
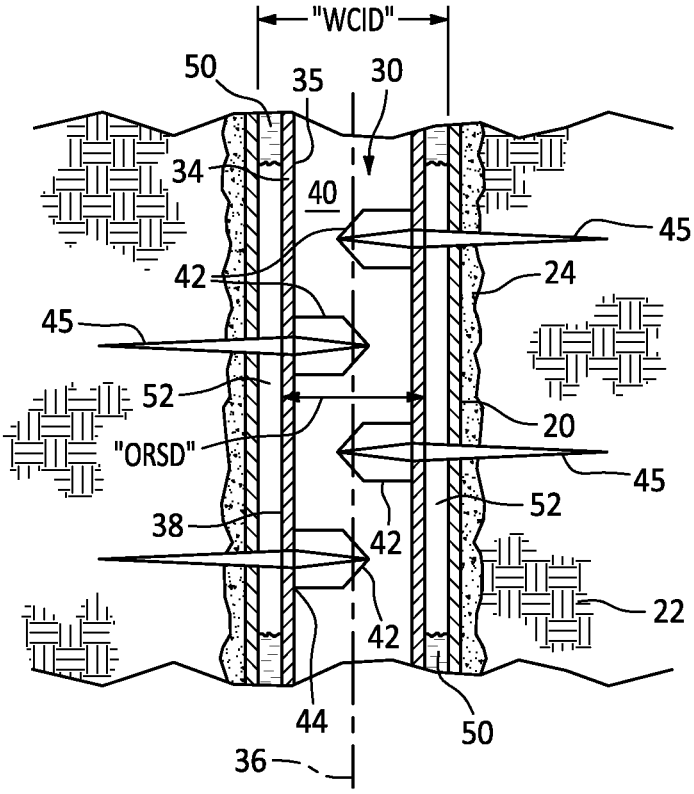
FIG. 7 diagrammatically illustrates a perforating gun embodiment disposed within a well casing according to the present disclosure in a fired state.
Figure 8:
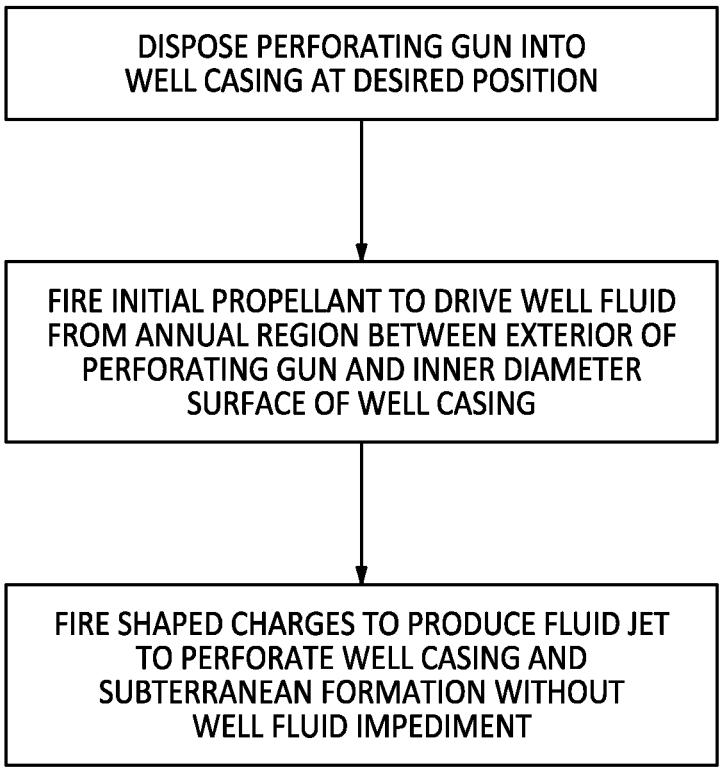
FIG. 8 is a flow chart illustrating aspects of the present disclosure.

According to an aspect of the present disclosure, a perforating gun 30 is provided having a body 34 with a lengthwise extending axis 36 (see FIGS. 6 and 7). The body 34 has at least one outer radial surface 38 and has an inner passage 40 that extends lengthwise between a first axial end and a second axial end. In FIG. 5, the perforating gun 30 is shown as having a second axial end 41 that is downhole of a first axial end 43. In some perforating gun 30 embodiments, cap sections (not shown) may be used to enclose the inner passage 40 at each lengthwise end of the body.

The perforating gun 30 includes a plurality of shaped charges 42 mounted within the body 34. Each shaped charge 42 may be disposed within a shaped charge cavity 44 disposed in the outer radial surface 38 of the body 34. The outer radial surface of the body 34 proximate the shaped charges 42 is shown as "ORSD" in FIG. 7. Each shaped charge 42 is directly or indirectly in communication with the inner passage 40. The shaped charges 42 may be positioned at a variety of axial and circumferential positions along the body 34 of the perforating gun 30. The present disclosure is not limited to any particular number of shaped charges 42, or the relative positioning of those shaped charges 42 on the body 34.

Each shaped charge 42 includes an explosive material and a structure that is configured to produce, upon firing, a fluid jet 45 that extends radially outwardly (i.e., substantially perpendicular to the body lengthwise axis 36). The present disclosure is not limited to any particular shaped charge 42 configuration; e.g., a shaped charge 42 that includes an outer casing and a conical liner, with the explosive material sealed within the outer casing by the conical liner is an example of an acceptable shaped charge 42 configuration. Acceptable examples of explosive materials include, but are not limited to, Cyclotrimethylenetrinitramine, C3H6N606 (sometimes referred to as "Royal Demolition Explosive" or "RDX"), cyclotetramethylene-tetranitramine (sometimes referred to as "High Melting Explosive" or "HMX"), Hexanitrostilbene (sometimes referred to as "HNS" or "JD-X"), and 2,6-Bis (Picrylamino)-3,5-dinitropyridine (sometimes referred to as "PYX"). All of the plurality of shaped charges within the perforating gun 30 may have a uniform configuration, but that is not required.

Perforating gun 30 shaped charges are known in the oil and gas field, and come in a variety of different configurations and types. The present disclosure may be used with a variety of different perforating gun shaped charges 42, and therefore is not limited to any particular type of perforating gun shaped charge 42.

Figure 9:
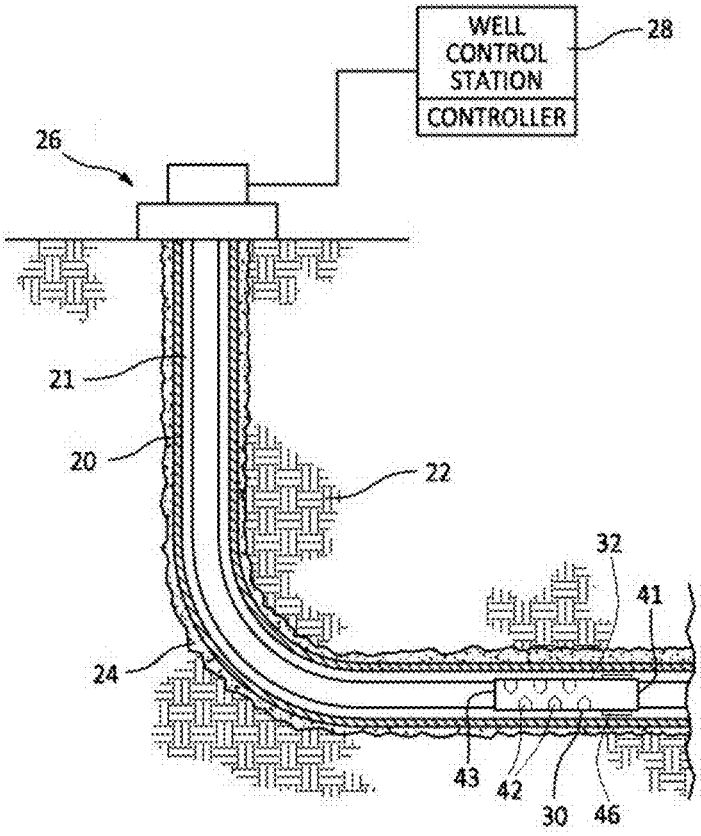
FIG. 9 is a diagrammatic illustration of a subterranean well having a perforating gun and well control station.

The present disclosure perforating gun 30 includes one or more initial propellants 46 that, upon firing, are operable to displace the well fluid 50 disposed in the annular region 48 surrounding the perforating gun 30. As will described below, the perforating gun 30 is configured and controlled so the initial propellant 46 is fired before the shaped charges 42 are fired. Upon firing, the initial propellant 46 produces an elevated pressure gas within the well casing 20 that drives the well fluid 50 within the annular region 48 away from the perforating gun 30 and therefore away from the shaped charges 42 incorporated into the perforating gun 30. Since the well casing 20 radially outside the perforating gun 30 is not yet perforated, the well fluid 50 in the annular region 48 travels within the well casing 20 away from the perforating gun 30. The displacement of the well fluid 50 from the annular region 48 creates a short-lived gas-gap 52 (e.g., see FIG. 7) in the annular region 48 between the perforating gun 30 and the well casing 20. Once the well fluid is temporarily displaced from the annular region 48, the shaped charge(s) 42 may be fired to perforate the well casing 20, the cement 24 disposed outside the well casing 20 (if present), and the subterranean formation 22 disposed radially outside of the perforating gun 30 without interference from well fluid 50 within the annular region 48. The perforating gun 30 may be configured with the one or more initial propellants 46 in any manner that permits the firing of the initial propellant 46 to displace the well fluid 50 in the annular region 48. The amount and/or type of initial propellant 46 is selected to provide sufficient force to displace the well fluid 50 in the annular region 48 for a period of time adequate for the shaped charges 42 to be fired with no well fluid 50 disposed within the annular region 48. As indicated above, solid propellants are a different material than the shaped charge explosive material; e.g., on a per weight basis, a solid propellant releases much less energy that the explosive material used in shaped charges, and that energy is produced substantially slower than the aforesaid explosive material (e.g., about 1,000 times slower). For the purpose of displacing the well fluid 50 in the annular region 48 for a period of time adequate for the shaped charges 42 to be fired, it is our experience that a solid type propellant can be used as an initial propellant. Non-limiting examples solid propellant types include potassium perchlorate, ammonium perchlorate, and barium perchlorate. The present disclosure is not limited to using any particular type of initial propellant 46, however. In some embodiments (as shown in FIG. 6), the initial propellant 46 may be aligned with the shaped charges 42. In some embodiments, the initial propellant 46 may be disposed on or in the perforating gun 30 at a position that will be downhole of the shaped charges 42 when the perforating gun 30 is located within the well casing 20 (e.g., disposed between the shaped charges 42 and a downhole axial end 41 of the body 34, see FIG. 9), or configured to produce the elevated pressure downhole of the shaped charges 42, or more specifically configured to produce an elevated pressure gas at a position downhole of the shaped charges 42, which elevated pressure gas is produced in a direction traveling from the down hole axial end to the upper axial end of the perforating gun 30. Well fluid may be considered to be an incompressible fluid. Locating the initial propellant 46 at a position that will produce the motive force to displace the well fluid 50 in a direction toward the well head 26 facilitates the displacement of the annular region 48 well fluid 50.

In some embodiments, the perforating gun 30 may include an actuating mechanism 54 (shown schematically in FIG. 6) configured to permit the one or more initial propellants 46 and the shaped charges 42 to fire in a predetermined manner; i.e., fire the initial propellant 46 first, and subsequently fire the shaped charges 42 in a period of time while the annular region 48 has been cleared of well fluid 50. The actuating mechanism may assume a variety of different configurations, and the present disclosure is not therefore limited to any particular actuating mechanism 54 configuration. As a first example, an actuating mechanism 54 within a perforating gun 30 may include a first electrical detonator that is in communication with the initial propellant(s) 46 and a second electrical detonator that is in communication with the shaped charges 42. A first control signal from the well control station 28 may cause the first electrical detonator to fire initial propellant(s) 46 and a second control signal sent subsequently from the well control station 28 may cause the second electrical detonator to fire the shaped charges 42. Alternatively, an actuating mechanism 54 within a perforating gun 30 may include a control module in communication with the aforesaid first and second electrical detonators. Once a control signal from the well control station 28 is received by the control module, the control module sends a signal to the first electrical detonator to fire the initial propellant(s) 46, and subsequently sends a second signal to the second electrical detonator to fire the shaped charges 42. As a further alternative, if the perforating gun 30 is mechanically actuated by a drop bar, the impact of the drop bar may cause actuating of the initial propellant 46, and actuate a delay mechanism (e.g., a fuse or other device) that is operable to fire the shaped charges 42 after a period of time. As yet another alternative, the initial propellant may be actuated by exposing the perforating gun 30 to a first pressure within the well casing 20, and the shaped charges 42 may be actuated by exposing the perforating gun 30 to a second higher pressure. For example, the perforating gun 30 may have a first actuator that operates once a first pressure rupture disk is burst, and a second actuator that operates once a second pressure rupture disk is burst, which second rupture disk is configured to rupture at a higher pressure than the first rupture disk; i.e., the second pressure is greater than the first pressure. Once the perforating gun is in the desired position within the well casing 20, the well fluid may be pressurized to reach the first pressure, thereby causing the first rupture disk to rupture and cause the first actuator to fire the initial propellant 46. The firing of the initial propellant 46 may create a locally elevated pressure within the well casing that is adequate to cause the second rupture disk to rupture and cause the second actuator to fire the shaped charges 42. In still further alternative embodiments, the actuating mechanism 54 may include hardware that sequentially fires the initial propellant 46 and then the shaped charges 42 using sensor input (e.g., temperature sensors, pressure sensors, etc.). The above actuating mechanism 54 example are provided to illustrate possible actuating mechanisms that may be used, and the present disclosure is not intended to be limited thereto. In addition, the actuating system that is used to fire the initial propellant 46 first, and subsequently fire the shaped charges 42 in a period of time while the annular region 48 has been cleared of well fluid 50, may be implemented entirely within the well control station 28, or may include elements disposed within both the perforating gun 30 and the well control station 28.

During operation of the system, the perforating gun 30 is inserted into a well casing 20 to a desired downhole position for perforation. Once positioned, an operator may utilize the well control station 28 to actuate the perforating gun 30. Alternatively, in some embodiments the operator may need not use a well control station 28 to actuate the perforating gun 30; e.g., the perforating gun 30 may include sensors that cause actuation upon one or more parameters (e.g., temperature, pressure, time, etc.) being satisfied. Either way, once the perforating gun 30 is actuated, the actuating mechanism 54 of the perforating system operates to fire the one or more initial propellants 46. For a very short period of time after the initial propellants 46 are fired, the well fluid 50 displaced from the annular region 48 will remain displaced until pressures equalize within the well casing 20. This period of time may be referred to as the "displacement dwell time". During this period of time, the actuating mechanism 54 operates to fire the shaped charges 42 (the shaped charges 42 may be fired together or in some predetermined order). Each shaped charge 42 produces a fluid jet 45 that passes through the standoff distance between the outer radial surface 38 of the perforating gun 30 and the inner diameter surface 35 of the well casing 20 (now devoid of well fluid 50), perforates the well casing 20, the cement 24 disposed outside the well casing 20 (if present), and extends into the subterranean formation 22. Hence, the impediment to the shaped charge fluid jet 45 caused by the well fluid 50 in the annular region 48 is eliminated. As a result, the entrance hole diameter ("EHD") through the well casing 20 and cement 24 and the formation penetration (PEN) are improved. A well application in an unconsolidated subterranean formation 22 (which typically requires a secondary sand control system), benefits from a larger EHD in the well casing 20. A well application in a high-compressive strength formation (e.g., carbonate, shale, sand, etc.) benefits from both a larger EHD in the well casing 20 and a larger PEN. The present disclosure can be used to provide both a larger EHD and a deeper PEN for a given shaped charge 42.

The present disclosure can provide other benefits as well. For example, a significant portion of the cost of a perforating gun 30 is related to the explosive material used in the shaped charges 42. The present disclosure eliminates the well fluid 50 impediment to the shaped charge fluid jet 45 during the perforation process. As a result, it may be possible to use less explosive material per shaped charge 42 and still form the same type perforation within the subterranean formation 22. Alternatively, it may be possible for a perforating gun 30 to have fewer shaped charges 42 per linear distance, and still get the same fracturing performance within the subterranean formation 22. As another example, U.S. Department of Transportation (USDOT) rules limit transportation of explosive materials on a cargo aircraft to no more than thirty-nine grams (39 gm) net explosive weight. Many legacy perforating guns require more than 39 gm net explosive weight to achieve a desirable perforating tunnel (EHD & PEN) downhole. In these cases, if air shipment of a perforating gun is required, then only a charter flight can be used, which greatly increases the cost and sometimes negatively affects availability. By improving the perforating gun performance by removing the well fluid 50 impediment, it may be possible to use less explosives to generate the same EHD and, PEN, thereby improving the transportation possibilities.

A method of perforating a well casing within a subterranean well according to the present disclosure, which well casing contains a well fluid, and has an inner passage defined by an inner surface, may include the following: a) providing a perforating gun having a body, a plurality of shaped charges mounted within the body, at least one initial propellant, wherein the perforating gun has an exterior diameter proximate the plurality of shaped charges; b) disposing the perforating gun within the well casing at a position in the well casing where the exterior diameter is less than an inner diameter of the well casing inner passage, at which position an annular region is disposed around the perforating gun and annular region is filled with well fluid; c) driving the well fluid out of the annular region by firing the at least one initial propellant in a manner the maintains the well fluid out of the annular region for a period of time; and d) perforating the well casing by firing the plurality of shaped charges during the period of time in which the well fluid is maintained out of the annular region.

In some embodiments of the present disclosure, a perforating gun 30 may include a secondary propellant that is configured similar to perforating guns described above. More specifically, the perforating gun may be configured to fire the secondary propellant after the shaped charges are fired, to produce an additional pressure even that can cause fracturing within the formation; i.e., an additional pressurization after the shaped charges are fired to physically change the formation perforation and thereby enhance fluid flow into the formation perforation and subsequently into the well casing.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure. One or more features described in connection with a first embodiment may be combined with one or more features of one or more additional embodiments.

What is claimed is:

1. A well casing perforation system for perforating a well casing within a subterranean well, the well casing containing a well fluid, and the well casing having an inner passage defined by an inner surface, comprising:

a perforating gun having a cylindrical body with an outer radial surface, the cylindrical body extending between a first axial end and a second axial end, disposed opposite the first axial end, wherein the cylindrical body is configured to have the second axial end disposed downhole of the first axial end during use, and the cylindrical body is configured to produce an annular region within the well casing between the outer radial surface of the cylindrical body and the inner surface of the well casing, the perforating gun further including a plurality of shaped charges mounted within the cylindrical body between the first axial end and the second axial end, and at least one initial propellant disposed on the outer radial surface of the cylindrical body axially between the plurality of shaped changes and the second axial end and configured to drive the well fluids within the annular region away from the plurality of shaped charges upon being fired in a direction from the second axial end toward the first axial end; and a controller configured to selectively cause the perforating gun to actuate when the perforating gun is disposed within the well casing, which actuation of the perforating gun includes first causing the at least one initial propellant to fire and to cause the volume of elevated pressure gas to drive the well fluids within the annular region away from the plurality of shaped charges for a period of time, and second causing the plurality of shaped charges to fire during the period of time.

2. The system of claim 1, wherein the at least one initial propellant is a solid propellant.

3. The system of claim 2, wherein the solid propellant includes at least one of potassium perchlorate, ammonium perchlorate, or barium perchlorate.

4. The system of claim 1, wherein the perforating gun includes a mechanically operated actuating mechanism, and the controller is configured to cause actuation of the perforating gun actuating mechanism.

5. The system of claim 1, wherein the perforating gun includes an electrically operated actuating mechanism, and the controller is configured to cause actuation of the perforating gun actuating mechanism.

6. A method of perforating a well casing within a subterranean well, the well casing containing a well fluid, and the well casing having an inner passage with an inner diameter surface, the method comprising:

providing a perforating gun having a cylindrical body, a plurality of shaped charges, and at least one initial propellant, the cylindrical body extending between a first axial end and a second axial end disposed opposite the first axial end, the cylindrical body having an outer radial surface, the plurality of shaped charges mounted within the cylindrical body between the first axial end and the second axial end, the at least one initial propellant disposed on the outer radial surface of the cylindrical body axially between the plurality of shaped charges and the second axial end, and wherein the cylindrical body outer radial surface is disposed at a first diameter and the well casing inner diameter surface is disposed at a second diameter, and the second diameter is greater than the first diameter;

disposing the perforating gun within the well casing inner passage with the second axial end of the cylindrical body downhole of the first axial end of the cylindrical body, and at a position where an annular region is formed between the cylindrical body outer radial surface and the well casing inner diameter surface and the annular region is filled with said well fluid;

driving the well fluid within the annular region in a direction from the second axial end of the cylindrical body toward the first axial end of the cylindrical body and out of the annular region by firing the at least one initial propellant disposed axially between the plurality of shaped charges and the second axial end, the propellant firing producing an amount of gas in the annular region at an elevated pressure relative to the well fluid, the amount of gas in the annular region at said elevated pressure maintaining the well fluid out of the annular region for a period of time; and perforating the well casing by firing the plurality of shaped charges during the period of time in which the well fluid is maintained out of the annular region.

7. The method of claim 6, wherein the perforating gun includes a mechanically operated actuating mechanism, and the at least one initial propellant is fired by engaging the mechanically operated actuating mechanism.

8. The method of claim 7, wherein the mechanically operated actuating mechanism is engaged by a drop bar impact.

9. The method of claim 6, wherein the perforating gun includes an electrically operated actuating mechanism, and the at least one initial propellant is fired by engaging the electrically operated actuating mechanism.

10. The method of claim 9, wherein the electrically operated actuating mechanism is engaged by a signal sent from a well control station.

11. The method of claim 6, wherein the perforating gun includes a pressure operated actuating mechanism, and the at least one initial propellant is fired by subjecting the perforating gun to a predetermined first elevated pressure.

12. The method of claim 11, wherein the plurality of shaped charges are fired by subjecting the perforating gun to a predetermined second elevated pressure, which second elevated pressure is greater than the first elevated pressure.

* * * * *